US011035640B2

(12) United States Patent
Berti

(10) Patent No.: US 11,035,640 B2
(45) Date of Patent: Jun. 15, 2021

(54) REVERSIBLE QUIVER

(71) Applicant: BIGNAMI SpA, Ora (IT)

(72) Inventor: Marco Berti, Caldaro (IT)

(73) Assignee: Bignami Spa, Ora (IT)

( * ) Notice: Subject to any disclaimer, the term of this patent is extended or adjusted under 35 U.S.C. 154(b) by 44 days.

(21) Appl. No.: 16/578,883

(22) Filed: Sep. 23, 2019

(65) Prior Publication Data

US 2020/0096284 A1 Mar. 26, 2020

(30) Foreign Application Priority Data

Sep. 24, 2018 (IT) ..... 102018000008842

(51) Int. Cl.
*F41B 5/06* (2006.01)

(52) U.S. Cl.
CPC ..... *F41B 5/063* (2013.01)

(58) Field of Classification Search
CPC .. F41B 5/06; F41B 5/063; F41B 5/066; Y10S 224/916
See application file for complete search history.

(56) References Cited

U.S. PATENT DOCUMENTS 2,771,620 A * 11/1956 Hoffman ..... F41B 5/063 206/315.11
3,696,978 A * 10/1972 Gentellalli ..... F41B 5/063 206/315.11
5,193,725 A * 3/1993 Radocy ..... A45F 5/14 224/197
5,791,537 A * 8/1998 Miller ..... A45F 3/04 224/583
5,961,017 A * 10/1999 Mehler ..... A45C 7/009 224/153
7,942,141 B1 * 5/2011 Love ..... F41B 5/066 124/86
2006/0065261 A1 * 3/2006 Files ..... F41B 5/066 124/86
2006/0086768 A1 * 4/2006 Cotlong ..... F41B 5/063 224/607
2009/0151709 A1 * 6/2009 Tilby ..... F41B 5/063 124/44.5
2011/0174284 A1 * 7/2011 Hunt ..... F41B 5/066 124/44.6

* cited by examiner

*Primary Examiner* — Corey N Skurdal
(74) *Attorney, Agent, or Firm* — Ladas & Parry LLP

(57) ABSTRACT

Reversible quiver for performing the sport of archery, consisting of a support element (1) equipped with devices to secure it to the body of the sportsperson, and a containment element (2) for the arrows, which can be connected in an interchangeable fashion to the support element (1), wherein the connection devices (3) are of magnetic type, consisting of a female part (3*a*) and a male part (3*b*), and wherein this latter part can be inserted coaxially into the female part (3*a*), whilst disengagement occurs in the direction defined by the respective disengagement grooves provided on the female parts (3) and equipped with a single disengagement opening.

20 Claims, 2 Drawing Sheets

REVERSIBLE QUIVER

CROSS REFERENCE APPLICATION

This application claims the benefit of Italian Patent Application No. 102018000008842 filed on Sep. 24, 2018 the entire content of which is incorporated herein in its entirety.

DESCRIPTION

The invention relates to a quiver for archery, which can be assembled and which is convertible in a modular manner.

Quivers are known, which consist of a support element, which is usually provided with straps, in order to secure it to the sportsperson, and a containment element for the arrows, which is rigidly connected to or can be connected to the support element by means of known flexible fastening elements such as belts and/or snap connectors of plastic. These known quivers provide that the containment element for the arrows is attached externally, laterally to the support element, whereby the lateral, front or rear space requirement is increased, wherein, due to the flexibility of the connection with the support element, or the connection elements with the lower part is adjacent to the leg of the sportsperson and thereby impedes the freedom of movement of the sportsperson during the practice of certain sports disciplines, or causes chafing of the leg.

Furthermore, the known quivers do not provide a simple and quick connection system for assembling between the support and the containment element for the arrows and do not facilitate, e.g. the conversion of the construction for the discipline "target" to a construction for the discipline "field", from a quiver with arrows arranged in a single plane to a quiver with arrows arranged in two or several planes, by means of the elements.

From U.S. Pat. No. 7,942,141 B1, a quiver for arrows is known, in which a magnetic small plate is provided in the reception element, which covers the arrow tips, so that the arrow tips are held magnetically in their seat in the quiver, in order to secure them in their seat and to prevent rattling of the arrows in the quiver.

From US 2011/0174284 A1 a magnetic reception cap is known for a quiver mounted on a bow for archery. The reception cap is a housing with several magnets, which are fastened internally or externally on the housing, in order to be able to hold several arrow tips in the interior of the housing and to prevent a direct contact between the arrow tips.

On the above quivers, magnets are exclusively provided to hold the introduced arrow tips, not to be able to change the arrangement between the support element and the containment element in a problem-free and time-saving manner.

The invention is based on the object to create a quiver of the above-mentioned type that can be adapted to different personal requirements, the demands of different competitive disciplines or archery sport disciplines and/or to various conditions specified by the arrows and/or the regulations in an easy and time-saving manner. Whereby it is ensured that despite different assembly variants, the quiver is always predominantly adjacent to the body of the sportsperson only with the support element.

For solving this object, the invention suggests that the lower part of the support element essentially has a triangular shape, wherein one of the corners is directed downwards and that respectively two, spaced magnetic connection devices are provided at the two converging sides, which match corresponding magnetic connection devices on the containment element for the arrows. The magnetic connection devices are of a known type and have a form-fit plug connection, wherein the insertion direction between the male and the female part is coaxial, but the direction for release is determined by a groove arranged on the female part. According to the invention, the groove for release is arranged vertically on the lower connection device, and open upwards, while it is arranged horizontally at the upper connection element and open towards the sportsperson. This arrangement allows that the element for the reception of the arrows, by means of the connection devices on the support element, takes place in that the projecting "male" part of both connection devices is inserted coaxially into the seat of the corresponding respective "female" part on the support element. This arrangement of the magnetic connection devices prevents inadvertent disengagement of the containment element for the arrows from the support element. Whereby the disengagement requires pivoting of the containment element for the arrows with the upper part toward the sportsperson, in order to release the male part along the horizontal groove on the corresponding female connection part, in order to subsequently, by lifting the containment element for the arrows, pull out the male part of the lower connection device along the vertical groove of the corresponding female connection device.

By providing the magnetic connection devices on the support element in one plane, which passes vertically through the center region of the support element, or is provided in a vertical plane, which passes through the center region of the containment element for the arrows, it is achieved that this element transfers its weight substantially to the support element, which is adjacent in the region of the hip of the sportsperson, whereby it is prevented that the containment element for the arrows is adjacent to the leg of the sportsperson. This arrangement of the loads can be improved further in that the magnetic connection devices are provided in a plane, which is parallel and slightly offset toward the outside to the vertical center plane on the containment element, spaced further from the sportsperson.

In order to enable a modular assembly of containment elements for the arrows, which have a different type, shape and features, the invention suggests to provide magnetic connection devices of the same type at several outer surfaces of the elements, which are arranged in such a manner to enable the connection of the different containment elements for the arrows with the support element. The containment elements for the arrows can be assembled of a different number of tubes or containment compartments, which are arranged in a single plane, or in planes in parallel adjacent to each other. According to the invention, each containment element for the arrows can be equipped with two of the above-mentioned magnetic connection devices on the (narrow) side facing the support element, as well as on the opposite side.

On the outer (wider) side and on the side facing the sportsperson, the containment elements for the arrows themselves can be equipped with two magnetic connection devices, which are of the same, already described type, in order to be able to attach one or more containment elements for the arrows on the outer side.

In case of containment elements for arrows having a wider shape, it is advantageous that at least three or even four magnetic connection devices are provided, of which, also in this case, the lower ones are arranged with the disengagement groove in vertical position, while the upper ones are arranged with the disengagement groove in the horizontal position.

The invention will be explained in more detail by means of a preferred exemplary embodiment of an inventive reversible quiver, shown schematically in the drawings, wherein the drawings merely fulfill an explanatory, not limiting purpose.

Figure 1:
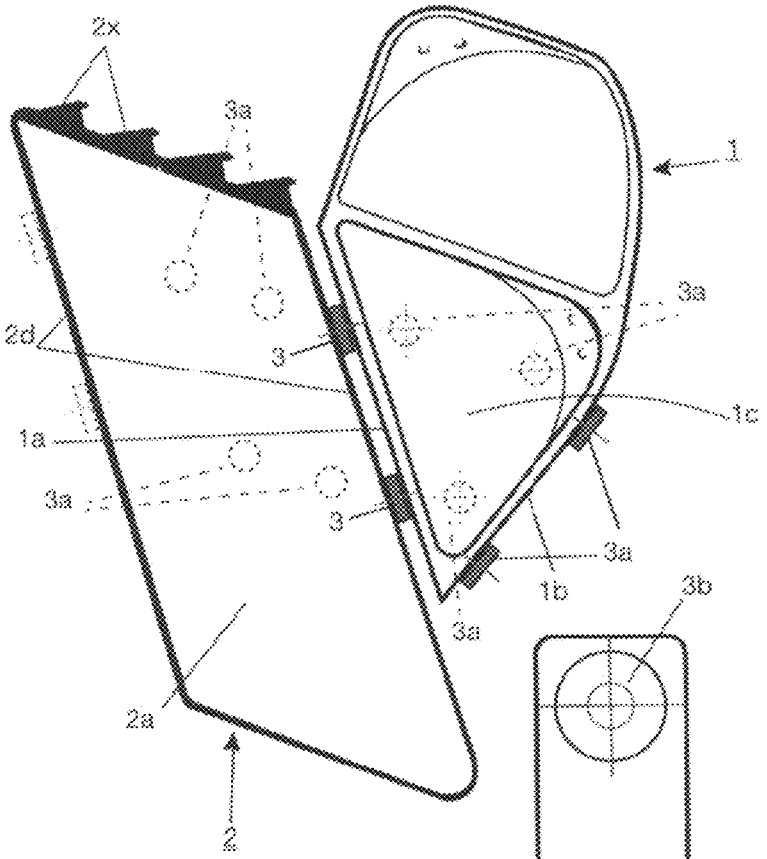
FIG. 1 shows the side view of a quiver according to the invention, which consists of a support element, at which is attached to a containment element for the arrows with four separate compartments.
Figure 2:
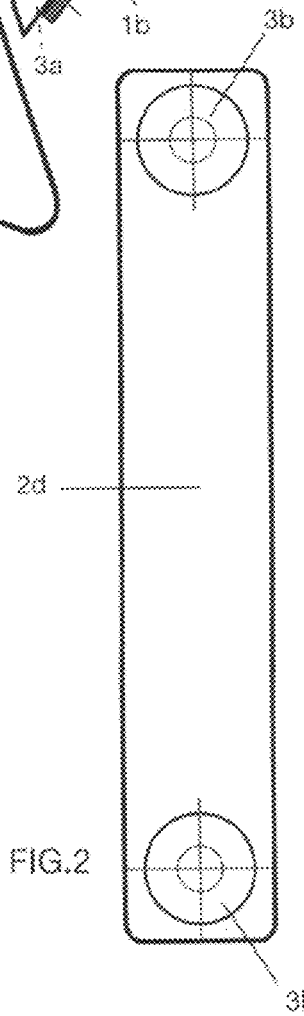
FIG. 2 shows the front view of the connection region of the containment element for the arrows having two male parts of the magnetic connection devices.
Figure 3:
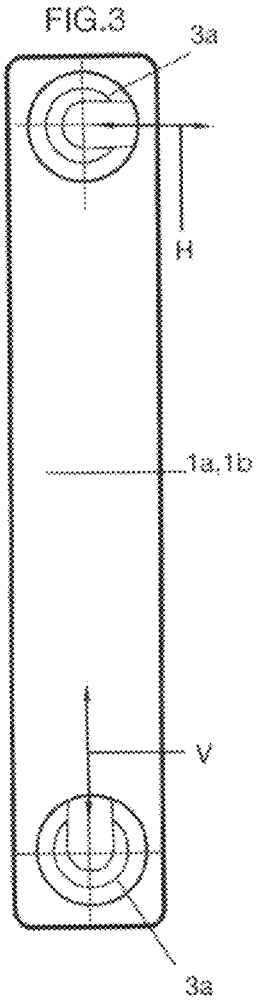
FIG. 3 shows the front view of the connection region of the support element having two female parts of the magnetic connection devices, which correspond to the male parts of the magnetic coupling devices shown in FIG. 2.
Figure 4:
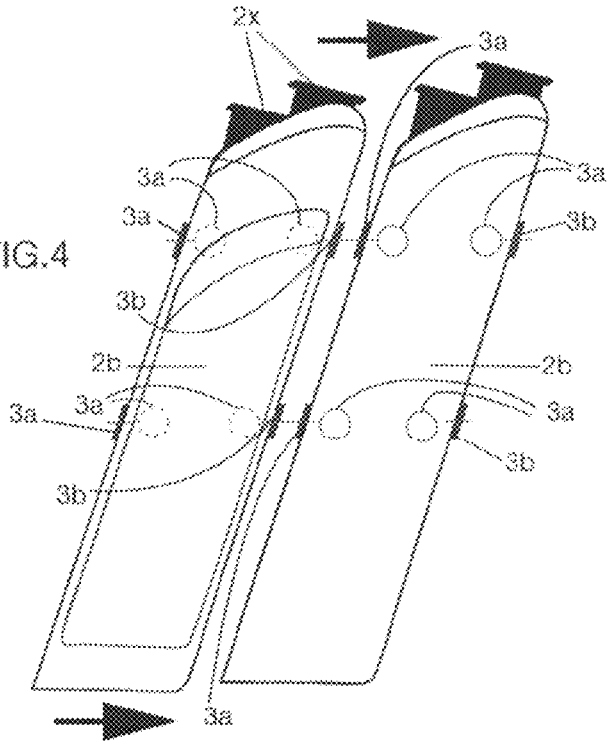
FIG. 4 shows the side view of the connection phase between two identical containment elements for the arrows, equipped on each of the wide sides with two magnetic connection devices and on each of the narrow sides with two magnetic connection devices.
Figure 5:
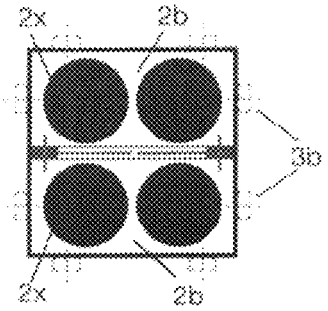
FIG. 5 shows the plan view of two containment elements for the arrows, which are connected by means of connection devices provided on the wide sides.
Figure 6:
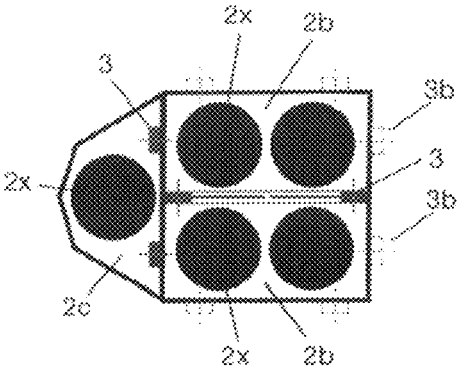
FIG. 6 shows the plan view of two containment elements the arrows, which are connected as illustrated in FIG. 5, to which a further containment element is attached frontally.

According to the invention, the quiver is essentially assembled of a support element 1 with known (not shown) elements for fastening to the body or belt of the sportsperson and of at least one containment element 2 for the arrows that can be attached to the support element 1 by means of at least two known magnetic connection devices 3 or be detached therefrom.

The support element 1, or its lower part, preferably has a triangular shape, one of the corners is thereby directed downwards, and are equipped on both converging sides forming this corner with the said magnetic connection devices 3, in particular, a female part 3*a* of the connection devices 3 spaced equally to each other, is provided. The containment element 2 for the arrows can be of a different type 2*a*, 2*b*, 2*c* with respect to the dimensions, the number of compartments 2*x* for the arrows and/or the arrangement of the compartments 2*x*.

The female parts 3*a* of the magnetic connection devices 3 in the lower position are arranged with vertically aligned disengagement grooves, open upwards, while the elements in the upper position are arranged with the disengagement grooves horizontally, towards the sportsperson. This arrangement prevents the inadvertent disengagement of the containment element 2 for the arrows from the support element 1.

The arrangement of the magnetic connection devices 3 on the support element 2 at two opposite sides 1*a*, 1*b* enables the use of the quiver, be it for right- as well as left-handed persons, and for "target" disciplines with feathered arrow tips inclined forwards, and also for "field" disciplines with feathered arrow tips inclined backwards.

The different containment elements 2*a*, 2*b*, 2*c* for the arrows can, apart from at the narrow sides, also at the wide sides, be equipped with at least two magnetic connection devices 3, without excluding that three or four connection devices 3 are also provided; in this case, the connection devices 3 are also arranged with a vertically aligned disengagement groove open upwards in the lower position, while the connection devices in the upper position are arranged with a horizontally aligned open disengagement groove, rearwards, against the force of gravity. The connection devices 3 enable the modular assembly of the containment elements 2 for the arrows of different type and/or shape 2*a*, 2*b*, 2*c* among each other, which can be attached to a single support element 1 as a block or individually.

The invention does not exclude that the support element 1 has the form of a trapezoid or a rectangle, with connection sides 1*a*, 1*b* arranged inclined with equal sides or with connection sides 1*a*, 1*b*, inclined differently with respect to the vertical, arranged in parallel, spaced equally or differently.

The invention does not exclude that the support element 1 is also equipped with magnetic connection devices 3 on the side 1*c* directed outwards, for attaching containment elements 2 for the arrows.

The invention claimed is:

1. A reversible quiver for performing the sport of archery, consisting of a support element having one surface configured to face a sportsperson and another surface configured not to face towards the sportsperson, said support element being equipped with one or more connection devices to secure it to the body of the sportsperson and at least one element for containing arrows which can be connected in an interchangeable fashion to the support element by magnetic connection devices, wherein the magnetic connection devices are formed by a female part and a male part, the male part being engageable coaxially with the female part and the female part including disengagement grooves and equipped with a single disengagement opening so that disengagement occurs in a direction defined by the disengagement grooves and disengagement opening on each female part.

2. The quiver according to claim 1, wherein the support element has a triangular or trapezoidal shape with an upper side in an approximately horizontal position and two sides converging downwards, wherein the sides are equipped with female parts of at least two magnetic connection devices spaced apart, wherein the female part in a lower position is arranged with the disengagement grooves vertically, open upwards, wherein the female part in an upper position is arranged with the disengagement grooves horizontally, open sideways, towards the sportsperson and that the spacing between the female parts provided on inclined sides of the support element correspond to the spacing between the male parts provided on one or both the sides of the element for containing arrows.

3. The quiver according to claim 2, wherein the support element has a rectangular shape wherein the two sides are essentially vertical opposite to each other, equipped with female parts of at least two magnetic connection devices.

4. The quiver according to claim 2, wherein the support element is equipped on the surface not facing towards the sportsperson, with female parts of at least one magnetic connection device.

5. The quiver according to claim 2, wherein the female parts of the magnetic connection devices provided on converging, or parallel, sides of the support element and the corresponding male parts provided on the at least one element for containing arrows are positioned in such a way that the surface of the support element facing towards the sportsperson is parallel with an essentially vertical plane passing through center region of the containment element for arrows.

6. The quiver according to claim 2, comprising more that one element for containing arrows and wherein the elements for containing arrows can be of a different type and have a different shape and containment capacity, with the containment compartments arranged aligned or parallel to each other and equipped, at least on one side, with magnetic connection elements.

7. The quiver according to claim 2, wherein at least one element for containing arrows is equipped, at least on one side not facing towards the sportsperson and/or a side facing towards the sportsperson, with at least two magnetic connection elements.

8. The quiver according to claim 2, wherein inclination of the element for containing arrows, and respective inclination of the arrows contained, with respect to vertical is determined by inclination of surfaces equipped with connection devices and/or the shape of the containment element.

9. The quiver according to claim 2, wherein inclination of the element for containing arrows, and respective inclination of the arrows contained, with respect to vertical, in the case of application of the element for containing arrows to the surface of the support element not facing toward the sportsperson, is determined by the positioning of the magnetic connection devices on the surface not facing towards the sportsperson and/or on the surface of the element for containing arrows facing towards the sportsperson, respectively towards the surface of the support element not facing towards the sportsperson.

10. The quiver according to claim 2, wherein the magnetic connection devices provided on the support element and on the at least one element for containing arrows are positioned in such a way as to allow the application of the element for containing arrows in various positions, so as to allow the application of several elements for containing arrows on the same support element and to allow modular combination between several containment elements of the same type or different type.

11. The quiver according to claim 1, wherein the support element has a rectangular shape wherein two sides are essentially vertical opposite to each other, equipped with female parts of at least two magnetic connection devices.

12. The quiver according to claim 11, wherein the support element is equipped on the surface not facing towards the sportsperson, with female parts of at least one magnetic connection device.

13. The quiver according to claim 1, wherein the support element is equipped on the surface, not facing towards the sportsperson, with female parts of at least one magnetic connection device.

14. The quiver according to claim 13, wherein the female parts of the magnetic connection devices provided on converging, or parallel, sides of the support element and the corresponding male parts provided on the at least one element for containing arrows are positioned in such a way that the surface of the support element facing towards the sportsperson is parallel with an essentially vertical plane passing through center region of the containment element for arrows.

15. The quiver according to claim 1, wherein the female parts of the magnetic connection devices provided on converging, or parallel, sides of the support element and the corresponding male parts provided on the at least one element for containing arrows are positioned in such a way that the surface of the support element facing towards the sportsperson is parallel with an essentially vertical plane passing through the center region of the containment element for arrows.

16. The quiver according to claim 1, comprising more than one element for containing arrows and wherein elements for containing arrows can be of a different type and have a different shape and containment capacity, with containment compartments arranged aligned or parallel to each other and equipped, at least on one, side with magnetic connection elements.

17. The quiver according to claim 1, wherein in that the at least one element for containing arrows is equipped, at least on one side not facing towards the sportsperson and/or a side facing towards the sportsperson, with at least two magnetic connection elements.

18. The quiver according to claim 1, wherein inclination of the element for containing arrows, and respective inclination of the arrows contained, with respect to vertical is determined by inclination of the surfaces of the support element equipped with connection devices and/or the shape of the containment element.

19. The quiver according to claim 1, wherein inclination of the element for containing arrows and respective inclination of the arrows contained, with respect to vertical, in the case of application of the element for containing arrows to the outer surface of the support element, is determined by the positioning of the magnetic connection devices on the surface not facing towards the sportsperson and/or on the surface of the element for containing arrows facing towards the sportsperson, respectively towards the surface of the support element not facing towards the sportsperson.

20. The quiver according to claim 1, wherein the magnetic connection devices provided on the support element and on the at least one element for containing arrows are positioned in such a way as to allow application of the element for containing arrows in various positions, so as to allow application of several elements for containing arrows on the same support element and to allow modular combination between several containment elements of the same type or different type.

* * * * *